US006618071B2

(12) United States Patent
Kaiho

(10) Patent No.: US 6,618,071 B2
(45) Date of Patent: Sep. 9, 2003

(54) EXPOSURE DEVICE INCLUDING PRE-DEFLECTION OPTICAL SYSTEM

(75) Inventor: Satoshi Kaiho, Yokohama (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/955,186

(22) Filed: Sep. 19, 2001

(65) Prior Publication Data

US 2003/0052961 A1 Mar. 20, 2003

(51) Int. Cl.[7] ..... B41J 15/14; B41J 27/00
(52) U.S. Cl. ..... 347/244; 347/259
(58) Field of Search ..... 347/241, 242, 347/243, 244, 256, 258, 259; 359/204

(56) References Cited

U.S. PATENT DOCUMENTS 5,828,401 A * 10/1998 Shiraishi ..... 347/259

FOREIGN PATENT DOCUMENTS

JP 2000-028941 1/2000

OTHER PUBLICATIONS

Junya Azami, Publication No. U.S. 2002/0021478 A1, Feb. 21, 2002.*

* cited by examiner

*Primary Examiner*—Hai Pham
(74) *Attorney, Agent, or Firm*—Foley & Lardner

(57) ABSTRACT

An exposure device has a plurality of light emitting units for emitting laser beams based on image signals. These laser beams emitted from the respective light emitting units are combined through respective galvanomirrors and half mirrors and conducted through a cylindrical lens to a polygon mirror. The respective combined beams reflected on the polygon mirror are illuminated onto an exposure light position on the surface of a photosensitive drum through two fθ lenses and a mirror. At this time, through the rotation of the polygon mirror, the respective laser beams are deflected in a main scanning direction and, through the rotation of the photosensitive drum, they are deflected in a sub-scanning direction to allow the surface of the photosensitive drum to be scanned with the exposure beams. At a position downstream of the cylindrical lens along a light path of the respective laser beams but upstream of the polygon mirror, a stop is so provided as to allow the combined beams to be passed and the cross-sectional configuration of the combined beams to be shaped. The stop shapes the cross-sectional configuration of the respective laser beams in the main scanning direction only.

8 Claims, 5 Drawing Sheets

FIG. 5
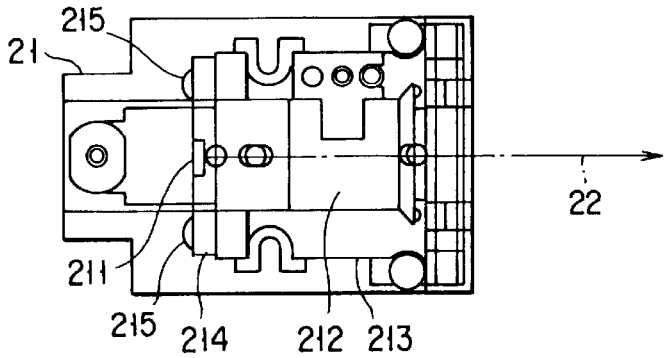
FIG. 6
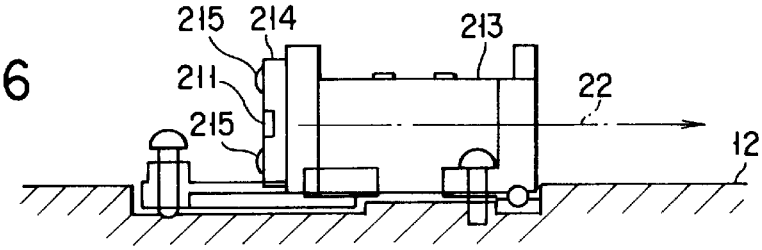
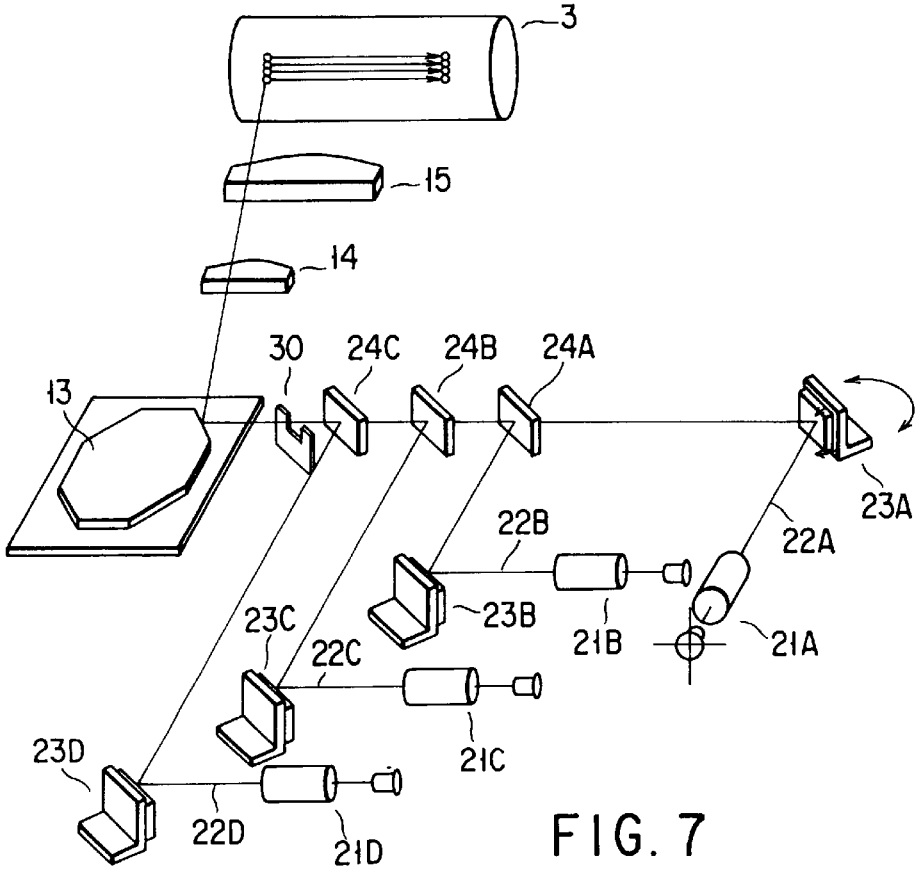
FIG. 7

EXPOSURE DEVICE INCLUDING PRE-DEFLECTION OPTICAL SYSTEM

BACKGROUND OF THE INVENTION

The present invention relates to an exposure device for an image forming apparatus and, in particular, to an exposure device used in a plurality of optical systems, such as a color copier and color printer.

In recent times, an image forming apparatus, such as a color copier and color printer, for forming a color image on a sheet with the use of a plurality of color toners has been increasingly used. This type of image forming apparatus is equipped with an exposure device for deflecting a plurality of laser beams for respective colors and, by doing so, scanning an image carrier with the exposure beams.

This exposure device has a plurality of laser beam sources for emitting laser beams on the basis of image data of respective colors. The respective laser beam sources are unitized with, for example, lenses and lens stops which shape the cross-sectional configuration of the laser beams to a desired configuration and provide light emitting units.

The laser beams for respective colors emitted through the stops from the respective light emitting units are combined respectively through a galvanomirror, half mirrors, cylindrical lens and are incident on the polygon mirror. The laser beams for respective colors reflected on the polygon mirror are illuminated through the fθ lenses onto an exposure light position on the photosensitive drum. Through the rotation of the photosensitive drum and the rotation of the polygon mirror, the laser beams for respective colors scan the surface of the photosensitive drum as exposure beams to form electrostatic latent images for respective colors on the drum surface.

If, however, respective stops are provided on the corresponding light emitting units for respective colors, then "shaped" laser beams are incident through the above-mentioned optical members onto the polygon mirror and the incident positions of the laser beams for respective colors are liable to be shifted, thus presenting a problem.

If the incident positions of the respective laser beams are so shifted relative to the polygon mirror, the latent images of respective colors formed on the drum surface are displaced, thus creating a color shift on a resultant image.

Further, the laser beam which has been passed through the stop is conducted through a plurality of optical members to the polygon mirror and, therefore, there are sometimes the cases where it is not possible to adequately exhibit the desired performance of the respective optical members.

BRIEF SUMMARY OF THE INVENTION

The present invention is achieved with the above in view and the object of the present invention is to provide an exposure device which can be made simpler in structure and further can shiftlessly direct a plurality of laser beams onto an image carrier as exposure beams without lowering their strengths.

In order to achieve the above-mentioned object of the present invention, an exposure device of the present invention comprises a plurality of light emitting sections which emit laser beams on the base of respective image signals; a deflecting/scanning section which deflect the plurality of laser beams emitted from the corresponding light emitting sections and scan an image carrier with the exposure beams to form latent images on the image carrier on the basis of respective image signals; a pre-deflection optical system which allow the laser beams emitted from the plurality of light emitting sections to be combined and the combined beams to be conducted to the deflecting/scanning section; and a single common optical member provided at a position downstream of the pre-deflection optical system along an optical path of the laser beams but upstream of the deflecting/scanning section, to allow the combined beams to be passed and a cross-sectional configuration of the combined beams to be shaped.

Further, an image forming apparatus of the present invention comprises an image carrier; an exposure device which form latent images on the image carrier on the basis of image signals; a developing device which supply toners to the latent images to effect development; a transfer unit which transfer a resultant toner image to a sheet; and a fixing device which fix the transferred toner image to the sheet, wherein the exposure device comprises; a plurality of light emitting sections which emit laser beams on the basis of the image signals; a deflection/scanning section which deflect laser beams emitted from the light emitting sections and scan the image carrier with the exposure beams; a pre-deflection optical system which allow the laser beams emitted from the plurality of light emitting sections to be combined and the combined beams to be conducted to the deflecting/scanning section; and a single common optical member provided at a position downstream of the pre-deflection optical system along an optical path of the laser beams but upstream of the deflecting/scanning section, to allow the combined laser beams to be passed and a cross-sectional configuration of the combined beams to be shaped.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

FIG. 5 is a plan view showing a light emitting unit incorporated into a pre-deflection unit of FIG. 4A;

FIG. 6 is a side view showing the light emitting unit of FIG. 5;

FIG. 7 is a view showing, as a model, a beam path of laser beams in the exposure device in FIG. 3.

DETAILED DESCRIPTION OF THE INVENTION

An embodiment of the present invention will be described below with reference to the accompanying drawing.

Figure 1:
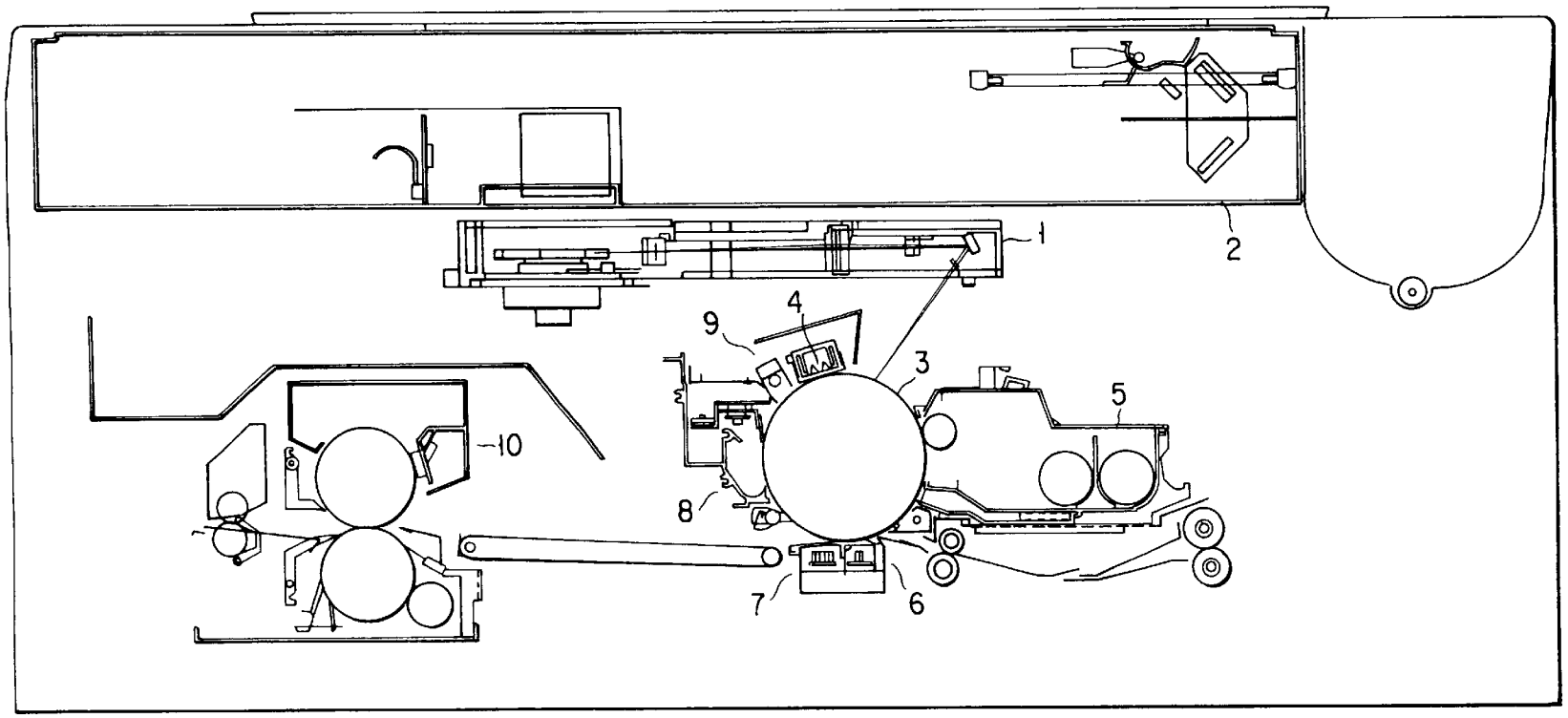
FIG. 1 is a diagrammatic view showing a color copier according to an embodiment of the present invention.

FIG. 1 is a diagrammatic view showing a structure of a color copier (hereinafter referred to simply as a copier) as an image forming apparatus.

The copier has a scanner 2 for reading out a document image and outputting an image signal. Below the scanner 2 a photosensitive drum 3 is provided as an image carrier. Around the photosensitive drum 3, a charger 4, an exposure device 1, developing unit 5, a transfer charger 6 (transfer unit), a separating charger 7, a cleaner 8 and a discharger 9 are provided. Further, a fixing device 10 is provided on the left side of the photosensitive drum 3 in a spaced-apart relation.

The exposure device 1 emits laser beams for respective colors on the basis of image signals read out by the scanner 2 and scans the surface of the photosensitive drum 3 with the exposure beams. The developing unit 5 supplies a toner of a corresponding color to an electrostatic latent image formed on the drum surface with the exposure beams to make the latent image visible, that is, to provide a toner image of a respective color. The transfer charger 6 transfers a toner image of the respective color which is formed on the drum surface to a sheet, not shown. The separating charger 7 separates the toner image-transferred sheet from the drum surface. The cleaner 8 eliminates remaining toner from the drum surface and the discharger 9 eliminates a remaining charge from the drum surface. The transfer device 10 allows the toner image-transferred sheet to be passed between a pair of rollers set in pressure contact with each other under the application of heat and, by doing so, the toner image to be thermally fused and fixed to the sheet.

The above-mentioned exposure device 1 will be explained in more detail below with reference to FIGS. 2 to 6.

Figure 2:
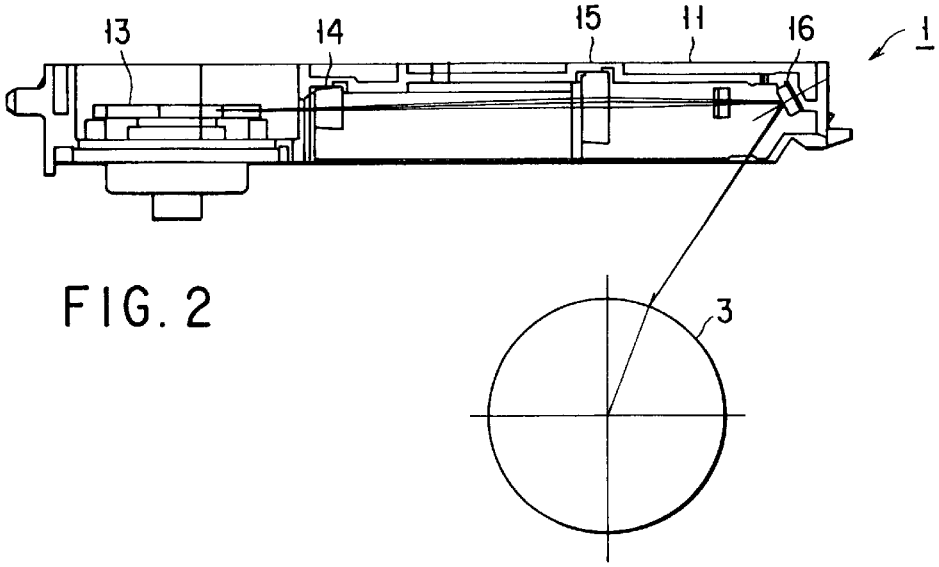
FIG. 2 is a front view showing an exposure device incorporated into the copier in FIG. 1.
Figure 3:
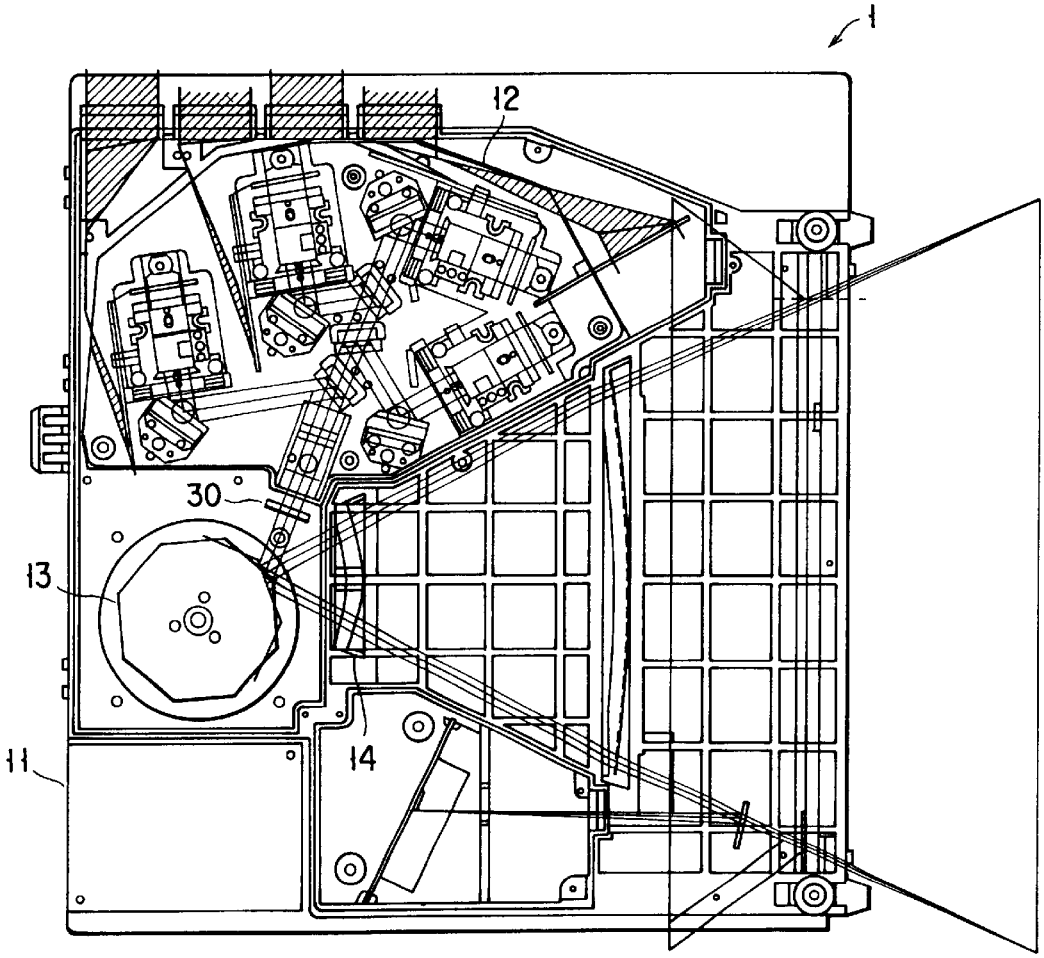
FIG. 3 is a plan view showing the exposure device of FIG. 2.

As shown in FIGS. 2 and 3, the exposure device 1 has a housing 11 constituting an outer shell. In those predetermined positions located within the housing 11, a pre-deflection unit 12, a polygon mirror 13 (deflecting/scanning section), two fθ lenses 14 and 15 and a mirror 16 are arranged.

Figures 4A, 4B:
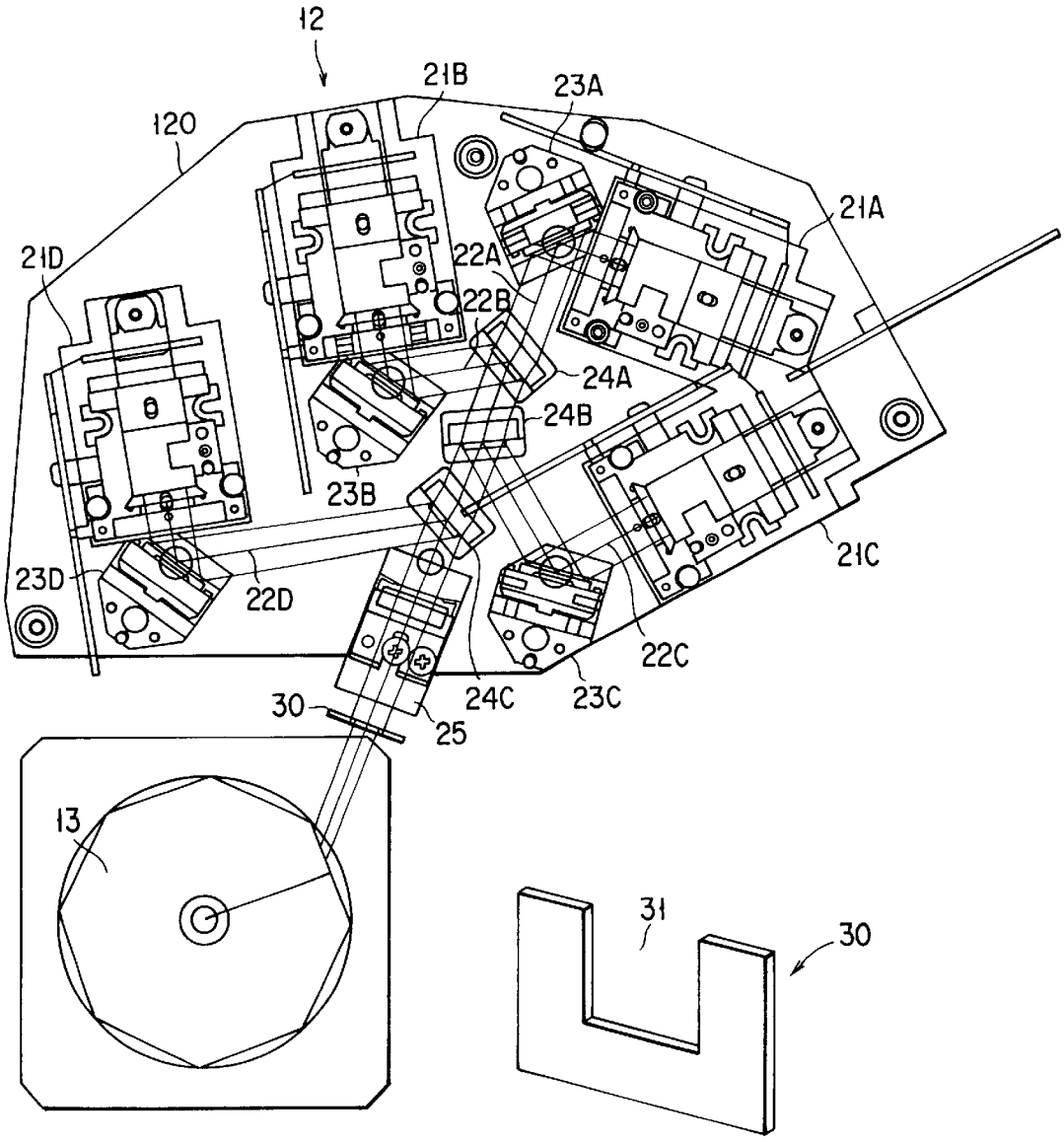
FIG. 4A is a detailed view, partly enlarged, showing an inner structure of the exposure device in FIG. 3.
FIG. 4B is a perspective enlarged view showing a stop of FIG. 4A.

As shown in FIG. 4A, a pre-deflection unit 12 has a casing 120 for holding a plurality of optical members therein. In those predetermined positions located within the casing 120, four light emitting units 21A, 21B, 21C and 21D (sometimes generally referred to simply as a light emitting unit 21 as the case may be) are arranged and function as light emitting sections of the present embodiment.

As shown in FIGS. 5 and 6, the respective light emitting units 21, each, have a semiconductor laser element 211 and a first lens 212. The semiconductor laser elements 211 emit laser beams 22 based on color-separated image signals. The first lens 212 has a finite focal point lens and collimator lens which shape a cross-sectional configuration of the laser beam. The first lens 212 is retained by a lens holder 213 made of a metal, such as die-cost aluminum, or a plastic, such as polycarbonate. The semiconductor laser element 211 is retained by an LD holder 214 and fixed by screws 215 to the lens holder 213.

On an optical path of a laser beam 22A emitted from a light emitting unit 21A, a polygon mirror 13 is provided which is arranged through a galvanomirror 23A, half-mirrors 24A, 24B and 24C and cylindrical lens 25 which are located in a highly accurate positional relation. The laser beam 22A emitted from the light emitting unit 21A is reflected on the galvanomirror 23A and then conducted through the three half-mirrors 24A, 24B, 24C and cylindrical lens 25 to the polygon mirror 13.

A laser beam 22B emitted from the light emitting unit 21B is reflected on a galvanomirror 23B located in a highly accurate position and then it is reflected on the first half-mirror 24A where it is combined with the laser beam 22A. The combined beam is conducted through the half-mirrors 24B, 24C and cylindrical lens 25 to the polygon mirror 13. A laser beam 22C emitted from the light emitting unit 21C is reflected on a galvanomirror 23C located in a highly accurate position and then it is reflected on the second half mirror 24B where it is combined with the above-mentioned laser beams 22A and 22B. The combined beam is conducted through the half mirror 24C and cylindrical lens 25 to the polygon mirror 13. Further, a laser beam 22D emitted from the light emitting unit 21D is reflected on the galvanomirror 23D located in a highly accurate position and then it is reflected on the third half mirror 24C and combined with the above-mentioned laser beams 22A, 22B and 22C. The combined light is conducted through the cylindrical lens 25 to the polygon mirror 13.

It is to be noted that the above-mentioned four galvanomirrors 23A, 23B, 23C and 23D, three half mirrors 24A, 24B, 24C and cylindrical lens 25 function as a pre-deflection optical system.

The laser beams for respective colors reflected on the polygon mirror 13 are deflected as exposure beams toward a main scanning direction through the rotation of the polygon mirror 13 and conducted through the two fθ lenses 14, 15 to the mirror 16 where it is reflected. The reflected beam 16 is directed to a predetermined exposure light position on the surface of the photosensitive drum 3. The two fθ lenses 14 and 15 have the function of correcting a variation in a tilt of each reflection face of the polygon mirror 13. Further, at this time, through the rotation of the photosensitive drum 3 the respective beams scan the drum surface in a sub-scanning direction and, by doing so, electrostatic latent images for respective colors are formed on the drum surface.

FIG. 7 shows, as a model, the transmission path of the respective laser beams 22A, 22B, 22C and 22D. According to this array, the respective laser beams enable their exposure light positions on the drum surface to be finely adjusted in the sub-scanning direction by adjusting the tilts of the corresponding galvanomirrors 23A, 23B, 23C and 23D in the sub-scanning direction. In the present embodiment, in order to achieve a resolution 600 of dpi, the angles of the respective galvanomirrors 23 are so set that the respective laser beams have their exposure light positions on the drum surface set at a pitch of 42 $\mu$m in the sub-scanning direction along the rotation direction of the photosensitive drum 3. The galvanomirrors have their angles so adjusted that, by detecting the exposure light positions of the respective laser beams by means of sensors, not shown, present at the surface positions of the drum, the exposure light positions of the respective laser beams are set at the above-mentioned pitch. This angle adjustment is made, for example, at a time of starting the copier or at a sheet-to-sheet interval timing.

The exposure device 1 of the present embodiment has a stop 30 (FIG. 4B) functioning as a single common optical member located at a position downstream of the cylindrical lens 25 along the path of the laser beam but upstream of the polygon mirror 13. The stop 30 is fixed to the housing 11 of the exposure device 1 and has a cutout 31 for allowing four laser beams to pass through and their cross-sectional configuration to be shaped. The cutout 31 is opened at its upper end to allow the cross-sectional configuration of the passing laser beams along the main scanning direction to be shaped and the cross-sectional configuration of the laser beams along the sub-scanning direction not to be shaped.

According to the present embodiment, as set out above, the stop 30 is fixed at a position downstream of the cylindrical lens 25 along the optical path of the laser beams but upstream of the polygon mirror 13 and, by doing so, it is possible to suppress a displacement of a laser beam incident position on the mirror face of the polygon mirror 13 in comparison with the case where, as in the prior art, a stop is provided integral with each light source. By doing so, it is possible to suppress a displacement of electrostatic latent images of respective colors formed on the surface of the drum 3 and to prevent a color shift from occurring on the outputted image.

Further, the stop 30 is arranged on the downstream side of the cylindrical lens 25 as set out above and there is no chance that, as in the prior art, those laser beams of once shaped cross-sectional configurations pass through the pre-deflection optical system. It is, therefore, possible to adequately ensure the performance of a plurality of optical members in the pre-deflection optical system.

Further, a plurality of laser beams are allowed to have their cross-sectional configuration to be shaped in the main scanning direction only by the stop 30 arranged immediately before the polygon mirror 13 and, even if the galvanomirror 23 arranged on the optical paths of the respective laser beams is adjusted in the sub-scanning direction, no adverse effect is exerted on the cross-sectional configuration of the respective laser beam and it is possible to suppress a lowering of a laser beam strength involved upon the shaping of the laser beam by a simpler structure of the stop 30 having the cutout 31 merely opened in the sub-scanning direction.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

Figure 8:
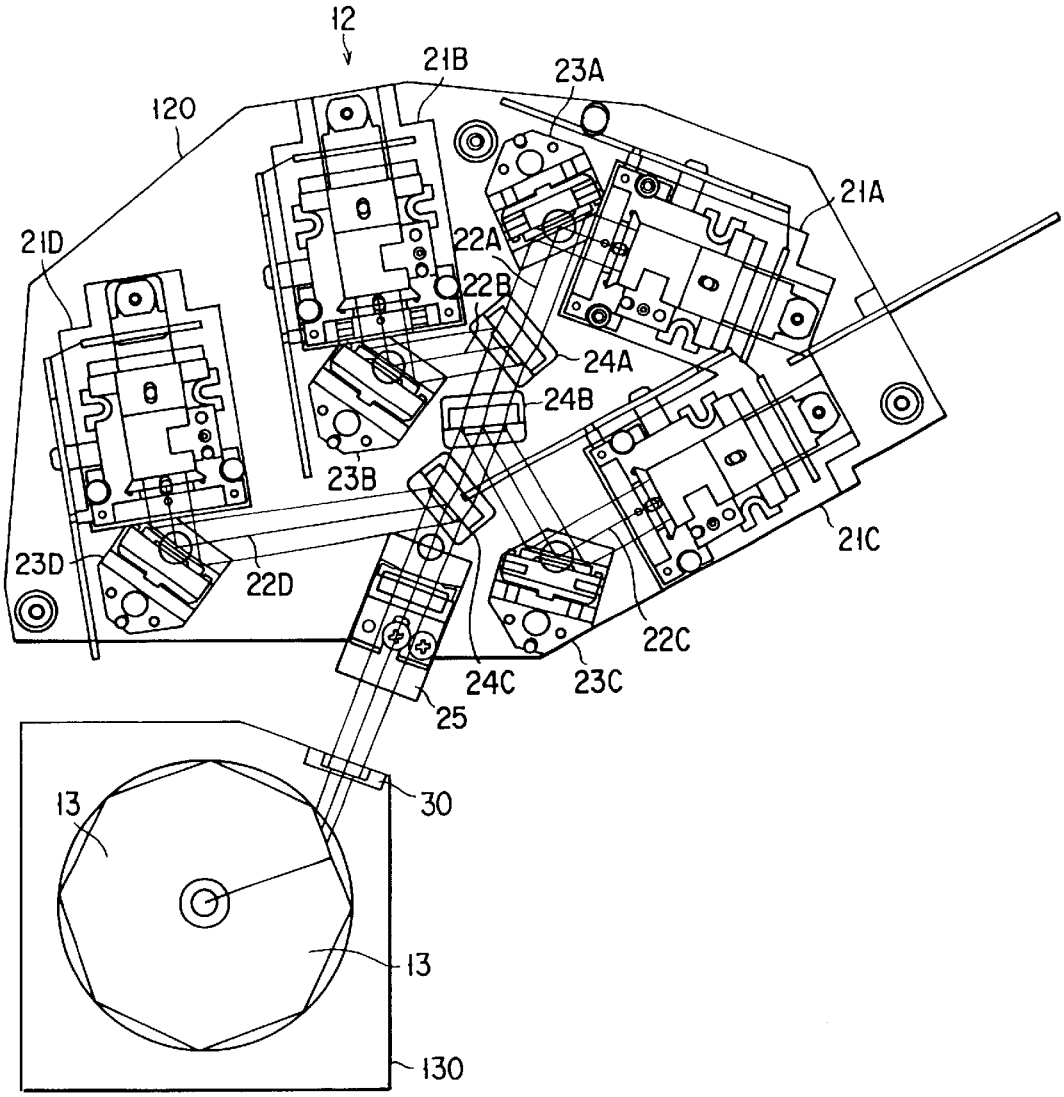
FIG. 8 is a view for explaining a stop mounted integral with a polygon mirror as an example.

Although, in the above-mentioned embodiment, the stop 30 has been explained as being fixed to the housing 11 of the exposure device 1 as an example, the stop 30 may be provided integral with a casing 130 as shown in FIG. 8. In this case, it is possible to heighten the positional accuracy of the stop 30 relative to the polygon mirror 13 in comparison with the above-mentioned embodiment.

What is claimed is:

1. An exposure device comprising:

a plurality of light emitting sections which emit laser beams on the basis of respective image signals;

a deflecting/scanning section which deflects the plurality of laser beams emitted from the corresponding light emitting sections and scans an image carrier with the exposure beams to form latent images on the image carrier on the basis of respective image signals;

a pre-deflection optical system which allows the laser beams emitted from the plurality of light emitting sections to be combined and the combined beams to be conducted to the deflecting/scanning section; and a single common optical member provided at a position downstream of the pre-deflection optical system along an optical path of the laser beams but upstream of the deflecting/scanning section to allow the combined beams to be passed and a cross-sectional configuration of the combined beams to be shaped, wherein the single common optical member allows the cross-sectional configuration of the combined beams to be shaped in a main scanning direction only in which the scanning of the deflecting/scanning section is performed.

2. An exposure device according to claim 1, further comprising a housing for holding the plurality of light emitting sections, deflecting/scanning section, pre-deflection optical system and common optical member therein and wherein the common optical member is integrally fixed to the housing.

3. An exposure device according to claim 1, wherein the single common optical member includes a cutout opened at an upper end to allow the cross-sectional configuration of the combined beams to be shaped in the main scanning direction only, and without shaping the cross-sectional configuration of the combined beams in the sub-scanning direction.

4. An exposure device comprising:

a plurality of light emitting sections which emit laser beams on the basis of respective image signals;

a deflecting/scanning section which deflects the plurality of laser beams emitted from the corresponding light emitting sections and scans an image carrier with the exposure beams to form latent images on the image carrier on the basis of respective image signals;

a pre-deflection optical system which allows the laser beams emitted from the plurality of light emitting sections to be combined and the combined beams to be conducted to the deflecting/scanning section; and a single common optical member provided at a position downstream of the pre-deflection optical system along an optical path of the laser beams but upstream of the deflecting/scanning section to allow the combined beams to be passed and a cross-sectional configuration of the combined beams to be shaped, wherein the common optical member is integrally fixed to the deflecting/scanning section.

5. An image forming apparatus comprising:

an image carrier;

an exposure device which forms latent images on the image carrier on the basis of image signals;

a developing device which supplies toners to the latent images to effect development;

a transfer unit which transfers a resultant toner image to a sheet; and a fixing device which fixes the transferred toner image to the sheet, wherein the exposure device comprises;

a plurality of light emitting sections which emit laser beams on the basis of the image signals;

a deflecting/scanning section which deflects laser beams emitted from the light emitting sections and scans the image carrier with the exposure beams;

a pre-deflection optical system which allows the laser beams emitted from the plurality of light emitting sections to be combined and the combined beams to be conducted to the deflecting/scanning section; and a single common optical member provided at a position downstream of the pre-deflection optical system along an optical path of the laser beams but upstream of the deflecting/scanning section to allow the combined laser beams to be passed and a cross-sectional configuration of the combined beams to be shaped, wherein the single common optical member allows the cross-sectional configuration of the combined beams to be shaped in a main scanning direction only in which the scanning of the deflecting/scanning section is performed.

6. An image forming apparatus according to claim 5, further comprising a housing for holding the plurality of light emitting sections, deflecting/scanning section, pre-deflection optical system and common optical member therein and wherein the optical member is integrally fixed to the housing.

7. An exposure device according to claim 5, wherein the single common optical member includes a cutout opened at an upper end to allow the cross-sectional configuration of the combined beams to be shaped in the main scanning direction only, and without shaping the cross-sectional configuration of the combined beams in the sub-scanning direction.

8. An image forming apparatus comprising:

an image carrier;

an exposure device which forms latent images on the image carrier on the basis of image signals;

a developing device which supplies toners to the latent images to effect development;

a transfer unit which transfers a resultant toner image to a sheet; and a fixing device which fixes the transferred toner image to the sheet, wherein the exposure device comprises;

a plurality of light emitting sections which emit laser beams on the basis of the image signals;

a deflection/scanning section which deflects laser beams emitted from the light emitting sections and scans the image carrier with the exposure beams;

a pre-deflection optical system which allows the laser beams emitted from the plurality of light emitting sections to be combined and the combined beams to be conducted to the deflecting/scanning section; and a single common optical member provided at a position downstream of the pre-deflection optical system along an optical path of the laser beams but upstream of the deflecting/scanning section to allow the combined laser beams to be passed and a cross-sectional configuration of the combined beams to be shaped, wherein the single common optical member is integrally fixed to the deflecting/scanning section.

* * * * *